US008820013B2

(12) United States Patent
Fennell

(10) Patent No.: US 8,820,013 B2
(45) Date of Patent: Sep. 2, 2014

(54) PLUG AND PLATE FOR WATERPROOFING AND METHOD FOR USING SAME

(75) Inventor: Shawn Fennell, Freeland, MD (US)

(73) Assignee: Mid-Atlantic Waterproofing of MD, Inc., Hanover, MD (US)

( * ) Notice: Subject to any disclaimer, the term of this patent is extended or adjusted under 35 U.S.C. 154(b) by 0 days.

(21) Appl. No.: 11/653,513

(22) Filed: Jan. 16, 2007

(65) Prior Publication Data

US 2008/0028696 A1 Feb. 7, 2008

Related U.S. Application Data

(63) Continuation-in-part of application No. 11/499,581, filed on Aug. 4, 2006, now abandoned.

(51) Int. Cl.

| | |
|---|---|
| ***E04B 1/66*** | (2006.01) |
| ***E02D 31/02*** | (2006.01) |
| ***E04B 1/70*** | (2006.01) |

(52) U.S. Cl.

CPC ..... *E02D 31/02* (2013.01); *E04B 1/7076* (2013.01); *E04B 1/7023* (2013.01)

USPC ..... 52/302.7; 52/169.5; 52/302.3

(58) Field of Classification Search

USPC ..... 52/169.5, 302.3, 302.7

See application file for complete search history.

(56) References Cited

U.S. PATENT DOCUMENTS

| | | | | |
|---|---|---|---|---|
| 2,239,255 A | | 4/1941 | Shaw | |
| 2,271,733 A | | 2/1942 | Clark | |
| 2,341,113 A | | 2/1944 | Nelson | |
| 2,427,664 A | | 9/1947 | Dunbar et al. | |
| 2,664,809 A | * | 1/1954 | Morell | 454/271 |
| 2,709,402 A | | 5/1955 | Malm | |
| 2,764,929 A | | 10/1956 | Tegarty | |
| 2,779,065 A | | 1/1957 | Rehme | |
| 2,782,464 A | | 2/1957 | Joppich | |
| 3,159,090 A | | 12/1964 | Schutt | |
| 3,283,460 A | * | 11/1966 | Patrick | 52/274 |
| 3,422,998 A | | 1/1969 | Murray | |
| 3,727,539 A | | 4/1973 | Wilmes | |
| 3,800,791 A | | 4/1974 | Visor | |
| 3,850,193 A | * | 11/1974 | Guzzo | 137/362 |
| 3,966,099 A | | 6/1976 | Sanford, Jr. et al. | |
| 4,222,315 A | | 9/1980 | Weirich | |

(Continued)

FOREIGN PATENT DOCUMENTS

| | | |
|---|---|---|
| GB | 2149494 | 6/1985 |
| GB | 2162305 A | 1/1986 |
| GB | 2281324 A | 3/1995 |
| KR | 2006013179 A | 2/2006 |

OTHER PUBLICATIONS

USPTO Office Action in U.S. Appl. No. 13/366,617 dated Aug. 5, 2013.

*Primary Examiner* — Basil Katcheves
*Assistant Examiner* — Joshua Ihezie
(74) *Attorney, Agent, or Firm* — Schott, P.C.

(57) ABSTRACT

A plate is provided that spans a space between a bleeder hole in a wall and a drainage trench in a floor adjacent the wall. The plate includes a base and a wall extension, substantially perpendicular to one another. The base extends from a point proximate to the wall to the trench where the base and the wall extensions are spaced apart from the floor and the wall, respectively.

9 Claims, 8 Drawing Sheets

(56) References Cited

U.S. PATENT DOCUMENTS

| | | | | | |
|---|---|---|---|---|---|
| 4,245,443 | A | * | 1/1981 | Beechen | 52/169.5 |
| 4,381,630 | A | * | 5/1983 | Koester | 52/169.5 |
| 4,569,208 | A | * | 2/1986 | Villa | 62/273 |
| 4,587,891 | A | * | 5/1986 | Kruse | 454/271 |
| 4,590,722 | A | * | 5/1986 | Bevelacqua | 52/302.3 |
| 4,612,742 | A | * | 9/1986 | Bevilacqua | 52/169.5 |
| 4,662,270 | A | | 5/1987 | Fiddler et al. | |
| 4,745,716 | A | * | 5/1988 | Kuypers | 52/169.5 |
| 4,757,651 | A | * | 7/1988 | Crites | 52/169.5 |
| 4,867,149 | A | | 9/1989 | Falco | |
| 4,869,032 | A | * | 9/1989 | Geske | 52/169.5 |
| 4,907,385 | A | * | 3/1990 | Biodrowski | 52/302.3 |
| 5,094,049 | A | | 3/1992 | Sells | |
| 5,113,967 | A | | 5/1992 | Killion et al. | |
| 5,277,003 | A | * | 1/1994 | Myers | 52/169.5 |
| 5,501,044 | A | * | 3/1996 | Janesky | 52/169.5 |
| 5,501,547 | A | * | 3/1996 | Mantelli | 405/121 |
| 5,522,769 | A | | 6/1996 | DeGuiseppi | |
| 5,765,323 | A | * | 6/1998 | Bevilacqua | 52/169.5 |
| 5,771,643 | A | * | 6/1998 | Parker | 52/169.5 |
| 5,936,208 | A | | 8/1999 | Hamery | |
| 6,230,468 | B1 | * | 5/2001 | Klaus | 52/741.11 |
| 6,662,504 | B2 | * | 12/2003 | Krogstad | 52/61 |
| 6,672,016 | B2 | * | 1/2004 | Janesky | 52/169.5 |
| 6,695,093 | B1 | | 2/2004 | Falco | |
| 6,964,136 | B2 | * | 11/2005 | Collins et al. | 52/209 |
| 6,994,621 | B2 | | 2/2006 | Mashiko et al. | |
| 7,166,024 | B2 | | 1/2007 | Mashiko et al. | |
| 7,553,104 | B2 | * | 6/2009 | Nordhoff | 405/43 |
| 7,832,156 | B2 | * | 11/2010 | Trotter | 52/169.5 |
| 7,980,035 | B1 | | 7/2011 | D'Apolito et al. | |
| 2005/0198916 | A1 | * | 9/2005 | Janesky | 52/169.5 |
| 2007/0092338 | A1 | * | 4/2007 | Nordhoff | 405/45 |
| 2007/0151190 | A1 | | 7/2007 | Huff et al. | |

* cited by examiner

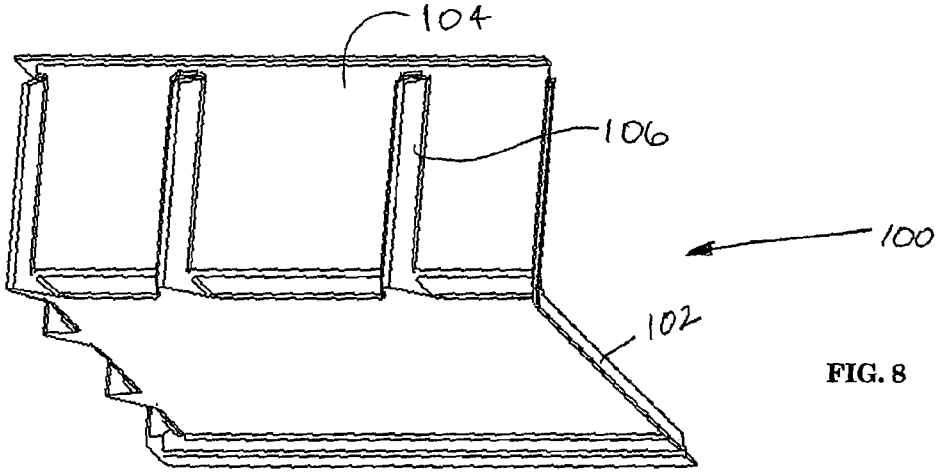
FIG. 8
FIG. 9
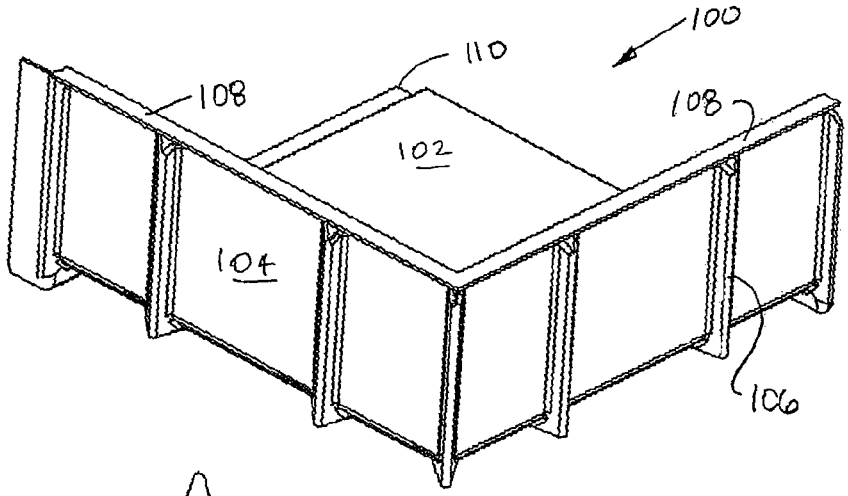
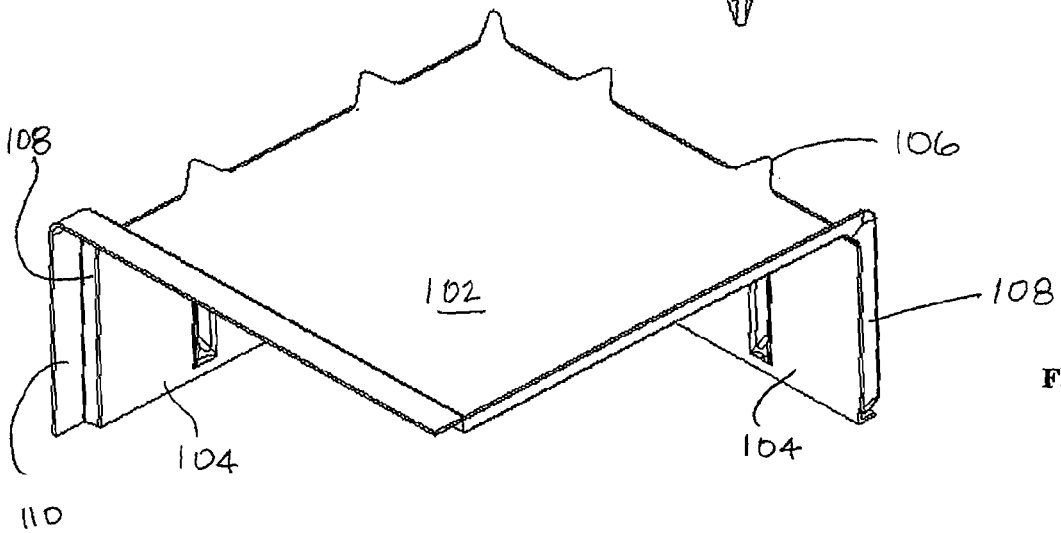
FIG. 10

PLUG AND PLATE FOR WATERPROOFING AND METHOD FOR USING SAME

CROSS REFERENCE TO RELATED APPLICATION(S)

This application is a continuation-in-part of U.S. patent application Ser. No. 11/499,581, filed Aug. 4, 2006, which is incorporated by reference as if fully set forth.

FIELD OF INVENTION

The field of the invention is waterproofing at- and below-grade rooms.

BACKGROUND

Ground and below-ground floors and walls often suffer water damage as water flows through the ground and into the walls and floors. This water flow at best causes dampness, and at worst, can shift a foundation or cause a catastrophic wall and/or floor cave-in. Between these two extremes lie the more common water damage effects like mildew, rot, and other property damage.

Water seepage into an underground basement often results from foundation settling. Some parts of the soil footing that the foundation rests upon may be weaker than others, and the result is an uneven distribution of a structure's weight, often stressing the wall and causing cracks, which create an entrance place for moisture.

This water seepage may be the result of heavy ground moisture. Areas in which clay subsoils, high water tables, or other poor drainage conditions can result in a tremendous hydrostatic force exerted by water in the ground that drives the water through a block wall's pores.

Solving these moisture seepage problems, particularly in below-ground rooms like basements, is the business of many companies. Their specialty is helping property-owners assess the sources of the water and seal against the water or redirect it.

The sealing solutions prevent the water's egress into the basement by sealing the basement walls and floor. For example, simply coating the interior of the basement wall is a common homeowner's solution that is unfortunately often ineffective because the coatings alone cannot withstand the hydrostatic pressure created by the water.

Another sealing solution includes using membranes along the outside surface of a basement wall. These membranes generally comprise fabric, tar, or asphalt that are disposed on the outside wall as a layer. This system is relatively expensive.

Another sealing example involves coating of waterproofing to the outside surface of the basement wall. Such a coating involves the use of bituminous emulsion or mastic without a membrane. The biggest disadvantage of this system is that its reliability diminishes under an extended and substantial hydrostatic pressure.

Solutions involving redirecting water can be done by rerouting gutters, grading the land outside the enclosed space, and installing exterior drains and runoffs.

More effective redirection involves capturing the incoming water and directing it from inside the basement to outside the basement. Such a water removal technique involves a series of common steps discussed with reference to FIG. 1, in which the interior of the basement is shown to the left of the wall 42, and the exterior is shown to the right of the wall 42.

First, an existing basement concrete floor 40 is removed to form a trench 44 adjacent the wall 42's edge. This trench 44 is usually formed approximately 12 inches from the wall 42's edge and parallels the basement's interior wall 42 to form the trench 44 for a drain, described in a subsequent step. (The wall 42 is shown as resting on a footer 64.)

Second, once dug out, the blocks 42 facing below the floor 40 are bled by drilling bleeder holes 46 through the block walls 42 into the core pocket/cell 48 (and into the mortar joints between the blocks) to remove excess water trapped therein.

Third, and depending on the type of wall material, the walls 42 may be treated with coatings 60 and/or a wallboard 62 may be installed over the block wall 42.

Fourth, the trench 44 is filled with washed gravel 50 or similar stone, which envelops a 4" A.D.S. flexible and coiled perforated piping 52. The trench 44 is covered with a vapor barrier material 54 and finished to grade with a cement layer 56. To aid in drainage, a rippled material under the vapor barrier can direct water from the bleeder hole 46 into the trench 44.

This interior drain system directs water from the pipe 52, where it flows to an area outside of the enclosed space, or to a pump (not shown) that pumps the water outside the basement.

This drain system works well, but one feature improves its performance. It can readily be seen that when the bleeder holes 46 are punched through to the cells 48 within the block walls 42, water exits more slowly that it would from on open vessel. The reason for this is back pressure: as water exits the cells through the hole, the space it once occupied must immediately be filled by the surrounding air; otherwise a vacuum results. As water leaves the cells 48 through the bleeder holes 46, atmospheric pressure forces air into the wall 42 to take its place, and slows the water exiting the cells 48. This doesn't prevent the water from exiting the cells 48, but it does slow its flow. (In a different but more common context, the flow of liquids exiting a can or bottle is regularly interrupted to allow air to enter, resulting in the familiar 'chug-chug' sound.)

To minimize back pressure, a second hole 51 connecting the cell 48 (or larger cell 49 formed of adjacent cells 48) to atmosphere is drilled into the wall 42. This second hole 51 allows air to enter the cells 48 and drive water through the bleeder hole 46.

The problem with this solution is that the second hole 51 often gets clogged with debris. Particularly with cinder block walls, the block 42 may crumble around the hole 51 and air flow. Once the second hole 42 is clogged, it becomes useless, and back pressure can prevent or inhibit the flow of water through the cells 48 into the French drain, causing water build-up within the cells 48, and potentially damaging the basement.

Another problem with this solution is that the bleeder holes 46 may be blocked or not drain into the trench 44.

SUMMARY

A corner and edge plate directs draining water from within the cells 48 to into the trench 44.

The open vent plug minimizes blockage within the second hole and insure consistent airflow through the cells to drive water into the bleeder hole. The open vent port has a hole therethrough that forms an opening joining the cells and atmosphere. The vent port preferably has a screened opening at one or both ends to prevent debris from blocking the second hole, and sidewalls of the open vent port prevent the wall from crumbling into the hole and blocking airflow therethrough.

The screen prevents insects from entering. This airflow also allows for continuous ventilation, thus airing out the walls after periods of heavy rain.

Similarly, a plate can be used in conjunction with the drainage system above. The plate is for use along a wall/floor boundary. The goal of the plates is to provide an open path from the bleeder hole to the trench. This facilitates water drainage and ventilation from the cells.

Other features of the invention are discussed below.

BRIEF DESCRIPTION OF THE DRAWING(S)

Further features and advantages of the invention will become clearer from the description of some preferred embodiments, made with reference to the attached drawings.

FIGS. 8 and 9 are isometric rear views of the inventive corner plate of FIGS. 6 and 7.

FIG. 10 is an isometric bottom view of the inventive corner plate of FIGS. 6 and 7.

DETAILED DESCRIPTION OF THE PREFERRED EMBODIMENT(S)

Figure 1:
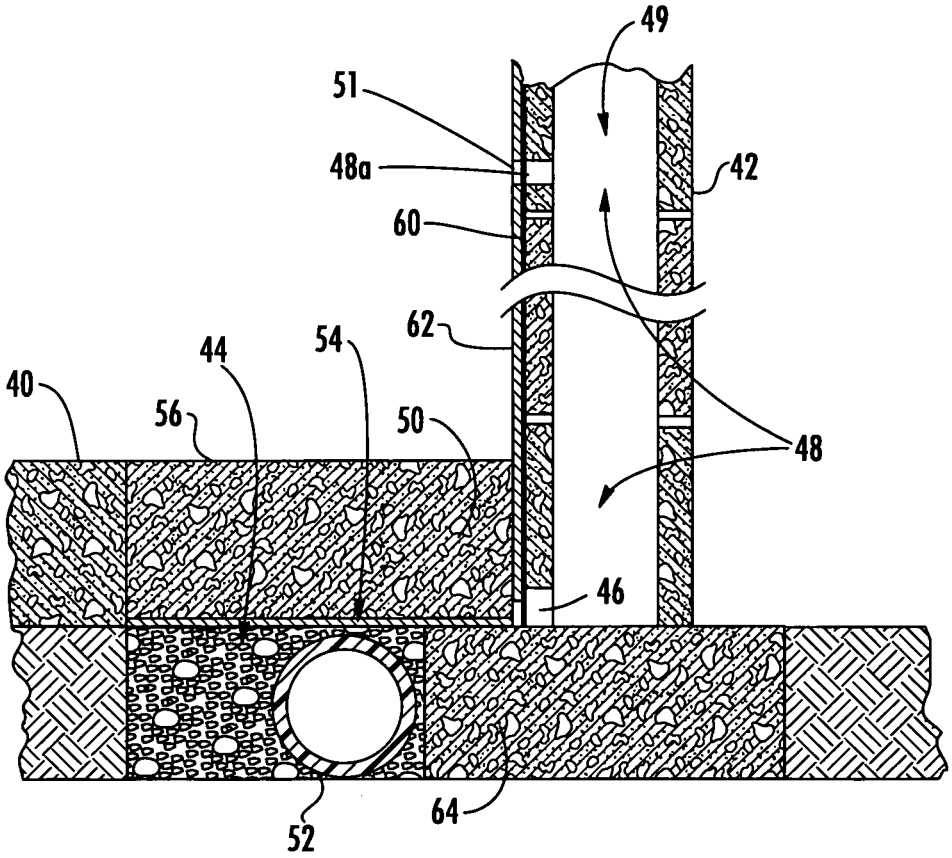
FIG. 1 (PRIOR ART)
FIG. 1 shows a partial cross section through a wall, floor, and drain system of the prior art.
Figure 3:
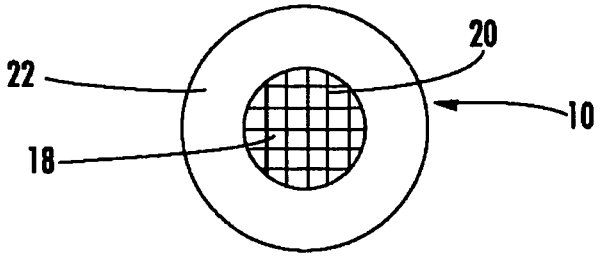
FIG. 3 is a front view of the open vent port of FIG. 2.
Figure 2:
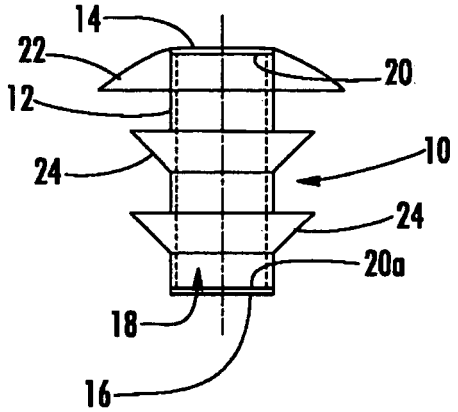
FIG. 2 is a side elevation view of the inventive open vent port.
Figure 4:
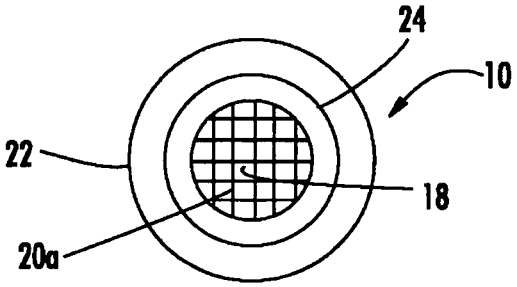
FIG. 4 is a rear view of the open vent port of FIG. 3.

FIGS. 2-5 show the open vent port 10 according to the invention. The open vent port 10 has an elongated body 12 with an open channel 18 extending longitudinally therethrough that joins two open ends 14, 16. The channel 18 also has at least one of screens 20, 20*a* to keep it free of debris.

The open vent port 10 has a first lip 22 extending from the open end 14 away from the body 12. This first lip 22 overlaps a surface of the wall 42 to prevent debris from entering the hole from inside the basement.

The open vent port 10 also has at least one second lip 24, preferably three lips 24, that press against the interior surface of the second hole 51 to secure the open vent port 10 in place within the wall 42. As best seen from the Figures, the first and second lips 22, 24 are preferably convex in opposite directions; the second lips being convex to aid in installation.

Figure 5:
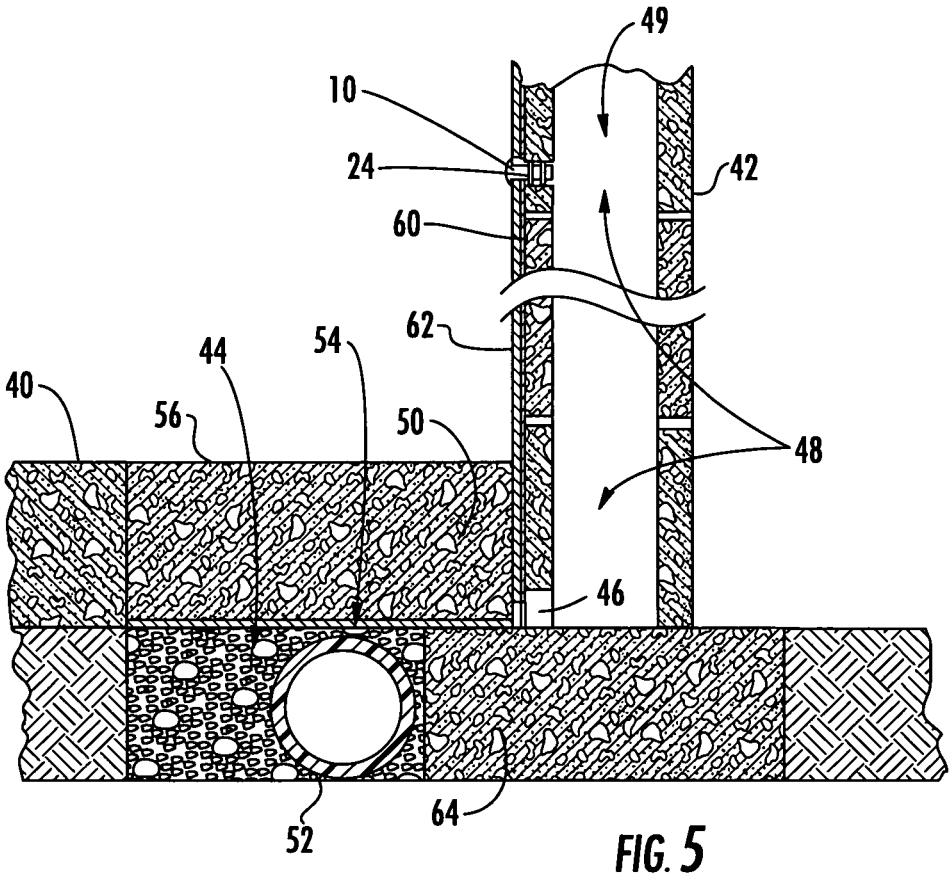
FIG. 5 is a partial cross section through a wall, floor, and drain system showing the open vent port of FIG. 1 installed.
Figure 6:
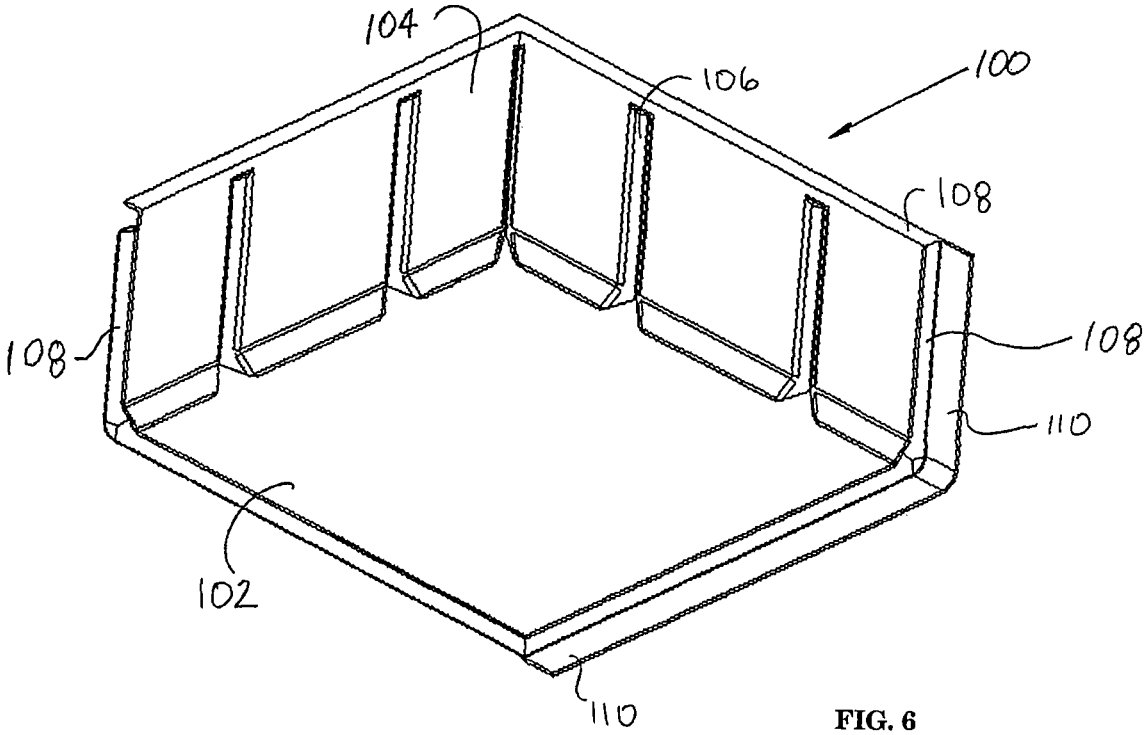
FIGS. 6 and 7 are isometric top views of an inventive corner plate.
Figure 7:
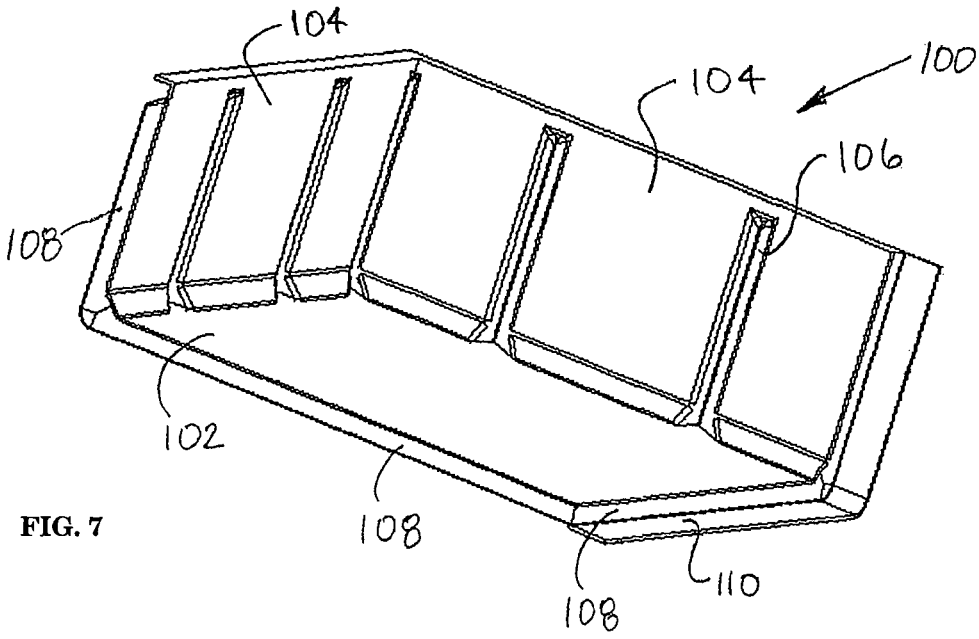
Figure 11:
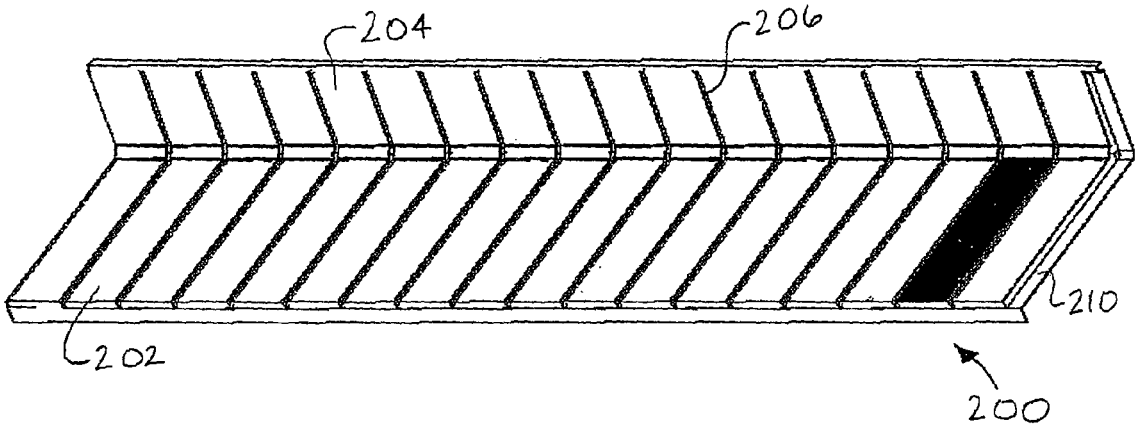
FIGS. 11 and 12 are isometric top views of an inventive edge plate.
Figure 12:
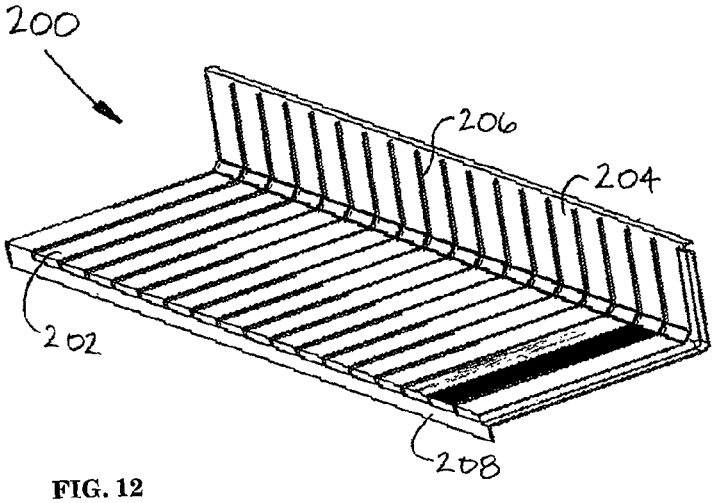
Figure 13:
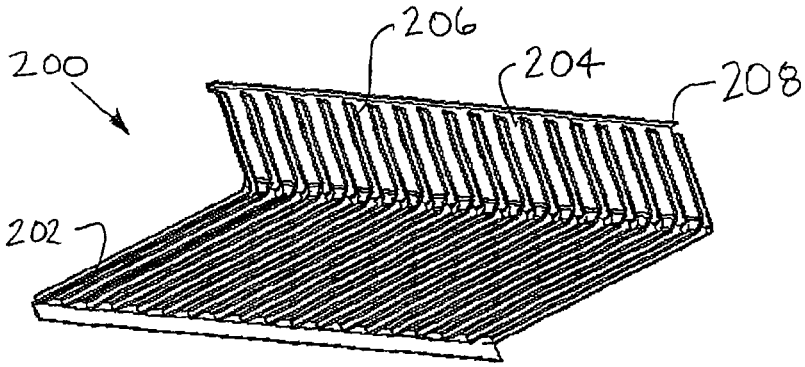
FIGS. 13-15 are isometric rear views of the inventive edge plate of FIGS. 11 and 12.
Figure 14:
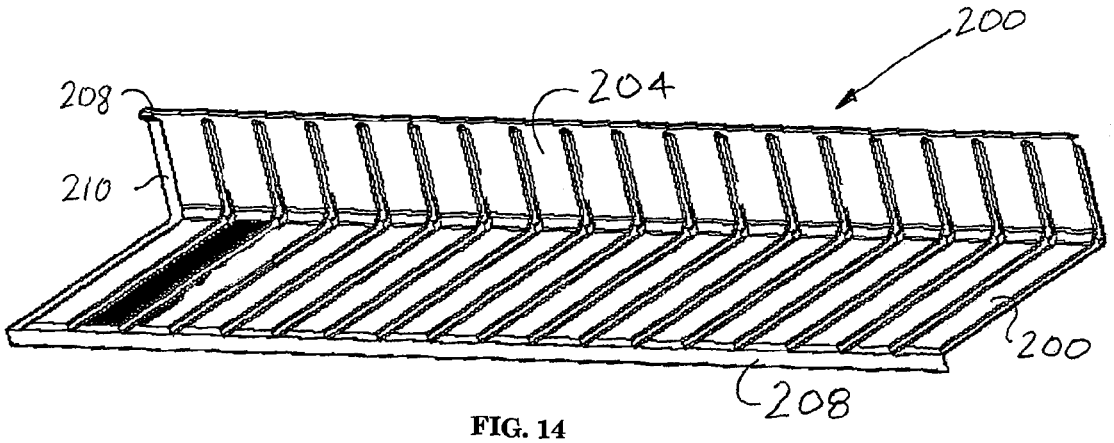
Figure 15:
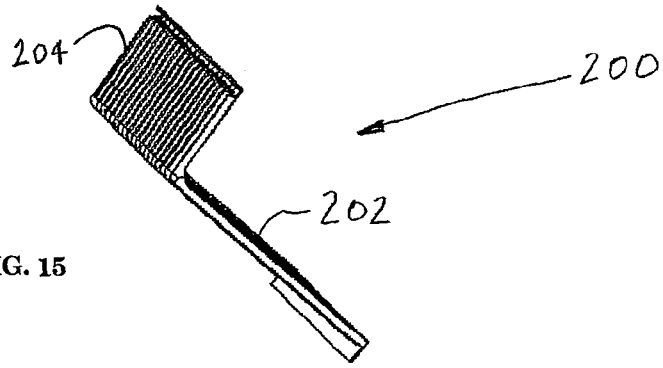

As best seen in FIG. 5, during a method of waterproofing using the open vent port 10, the open vent port 10 is pressed into the second hole 51 to join the open cells 48 to atmosphere (or at least the pressure within the basement). Once installed, the open vent port 10 and screens 20, 20*a* keep the channel 18 through the port 10 open. The result of the channel 18 remaining open and free of debris is that it relieves back pressure and allows air flow throughout the hollow cores of the block.

The open vent port 10 is preferably made of polyethylene. The first lip 22 has a preferable diameter of 1.5 inches and 1.25 inches long. These dimensions are chosen as the preferred dimensions based on their being commonly used with block walls 42.

FIGS. 6-16 show a plate 100, 200 that can be used in conjunction with the drainage system above. The corner plate 100 is obviously for use in a corner and the edge plate 200 is for use along a wall/floor boundary. The goal of both plates 100, 200 is to provide an open path from the bleeder hole 46 to the trench 44. This facilitates water drainage and ventilation from the cells 48.

FIGS. 6-10 show the corner plate 100 that would fit into a corner of a basement with the plate 100's wall extensions 104 adjacent and spaced apart from the walls 42. Similarly, the plate 100's base 102 is spaced apart from the floor, providing a gap 210 that allows liquid to run from the hole 46 to the trench 44.

The wall extensions 104 show a rib 106 that helps reinforce the wall extension 104 and maintain consistent spacing from the wall 42. Although not shown with respect to the corner plate 100, the base 102 could also comprise a similar reinforcing rib 106.

The wall extensions 104 and base 102 further comprise lips 108 that space the wall extensions 104 and/or base 102 away from the wall 42 and floor respectively.

During installation, corner plates 100 and edge plates 200 mate with each other to create a consistent boundary of plates between the floors and walls. The plates 100, 200 comprise mating tabs 110, 210 that facilitate this mating and if properly sealed at the tabs, create a waterproof seal.

FIGS. 11-15 show an edge plate 200 similar to the corner plate that comprises a base 202, wall extension 204, rib 206, and lips 208. The edge plate 200 could of course be of any length. This will not be described in greater detail since it should be appreciated that the edge plate 200 resembles the corner plate 100 in most respects.

Figure 16:
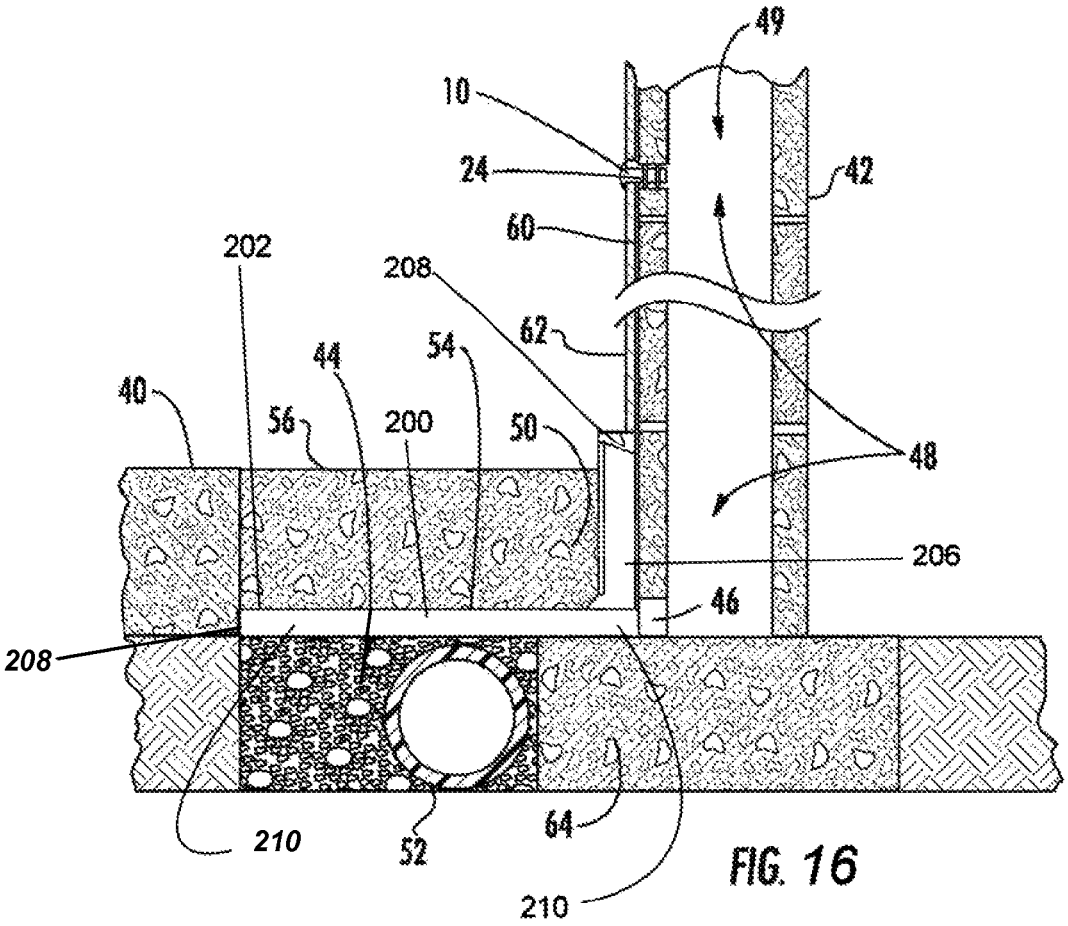
FIG. 16 is a partial cross section through a wall, floor, and drain system showing the plate of FIGS. 11-15 installed.

FIG. 16 shows a cross section through a wall showing an edge plate in cross section. As can be seen, water can flow from the bleeder hole 46 under the base 202 to the trench 44. As shown, it should be appreciated that during installation, the cement layer 56 covers the edge plate 200 and the wallboard 62 preferably rests against and adjacent the lip 208.

The corner and edge plates in FIGS. 6-15 are shown in use with the port 10 in a block wall; it should be understood, however, that these plates could also be used with a poured concrete, brick or stone wall and also need not be used in conjunction with the port 10. In the absence of the port 10, the plates alone could encourage the flow of seeping water to the trench 44.

It will be apparent to those skilled in the art that changes may be made to the construction of the invention without departing from the spirit of it. It is intended, therefore, that the description and drawings be interpreted as illustrative and that the following claims are to be interpreted in keeping with the spirit of the invention, rather than the specific details set forth.

It is also to be understood that the following claims are intended to cover all the generic and specific features of the invention herein described and all statements of the scope of the invention that, as a matter of language, might be said to fall therebetween.

What is claimed is:

1. A waterproofing system comprising:

a block wall comprising stackable blocks, wherein each block defines an open cell therein, wherein cells within blocks that are above and below one another are in fluid communication with each other;

a plate that spans a space from a block wall to and including a drainage trench in a floor adjacent the block wall, the plate comprising a base and a wall extension, substantially perpendicular to one another, the base extends from a point proximate to the wall to the trench, wherein the base and the wall extension are spaced apart substantially in their entirety from the floor and the block wall, respectively; and a vent port including an elongated body having an open channel with a constant diameter extending longitudinally therethrough that joins two open ends, the vent port installed into at least one of the stackable blocks in the block wall such that one end of the open channel is open to an area outside the block wall and another end of the open channel is open to one of the open cells, wherein the vent port comprises:

a screen spanning the open channel;

a convex annular first lip extending from the end open to the area outside the block wall towards the end open to one of the open cells; and a convex annular second lip extending from the body located between the two open ends, the second lip having a first end with a first diameter and a second end with a second diameter that is less than the first diameter, the first end being arranged closer to the convex first lip than the second end, wherein the convex annular first lip and convex annular second lip are convex in opposite directions;

wherein the open channel, open cells with vent ports installed thereto, and the drainage trench are in fluid communication with each other.

2. The system of claim 1, wherein at least one of the base or wall extension comprises a rib.

3. The system of claim 2, wherein the rib reinforces one of the base or wall extension.

4. The system of claim 1, wherein at least one of the base or wall extension includes a lip that spaces the base or wall extension apart from the floor or wall.

5. The system of claim 1, wherein the plate comprises mating tabs shaped to engage a mating tab of an adjacent plate.

6. The system of claim 1, wherein the plate comprises two wall extensions and the base, each of the base and two wall extensions being substantially perpendicular to one another.

7. The system of claim 1, wherein a horizontal surface of the base is spaced apart from, parallel to, and not in contact with, the floor.

8. The system of claim 7, wherein the horizontal surface is unribbed.

9. The system of claim 1, where the fluid communication passes through a bleeder hole in the block wall.

* * * * *